US007237276B2

(12) United States Patent
Longman

(10) Patent No.: US 7,237,276 B2
(45) Date of Patent: Jul. 3, 2007

(54) BATHTUB HAVING SLIDING ACCESS DOOR FOR THE DISABLED AND ELDERLY

(75) Inventor: Matthew James Longman, Kelowna (CA)

(73) Assignee: Aquassure Bath Products Inc., Kelowna (CA)

( * ) Notice: Subject to any disclaimer, the term of this patent is extended or adjusted under 35 U.S.C. 154(b) by 309 days.

(21) Appl. No.: 10/500,133

(22) PCT Filed: Jan. 10, 2003

(86) PCT No.: PCT/CA03/00015

§ 371 (c)(1),
(2), (4) Date: Jun. 25, 2004

(87) PCT Pub. No.: WO03/056992

PCT Pub. Date: Jul. 17, 2003

(65) Prior Publication Data

US 2004/0237184 A1 Dec. 2, 2004

(51) Int. Cl.
*A47K 3/02* (2006.01)

(52) U.S. Cl. ..... 4/555; 49/218

(58) Field of Classification Search ..... 4/555, 4/556; 49/218–221

See application file for complete search history.

(56) References Cited

U.S. PATENT DOCUMENTS 3,611 A * 6/1844 Bingham ..... 292/175
964,899 A * 7/1910 Carman ..... 49/218
2,570,053 A * 10/1951 Fowler et al. ..... 4/556
3,100,918 A 8/1963 Coverley ..... 49/477.1
3,371,354 A 3/1968 Havslett ..... 4/556
3,380,078 A 4/1968 Hanson ..... 4/555

(Continued)

FOREIGN PATENT DOCUMENTS

CA 1144708 4/1983

(Continued)

*Primary Examiner*—Robert M. Fetsuga
(74) *Attorney, Agent, or Firm*—Antony C. Edwards

(57) ABSTRACT

A bathtub for the disabled or elderly includes a tub (10) having an enclosure defined by at least one sidewall (10*a*), where the sidewall (10*a*) has a doorway therein providing access from an external side of the sidewall (10*a*), external to the enclosure, into the enclosure. A generally horizontal and vertically spaced apart pair of elongate guides (74, 82) are provided in the sidewall (10*a*). A door is slidably mounted to the guides (74, 82) on at least one pivotable linkage arm (70, 78). The pivotable linkage arm (70, 78) is pivotally mounted to both the door and at least one of the guides, and is adapted for generally horizontal translation along the sidewall (10*a*), in cooperation with the guides (74, 82), between a closed position wherein the door is releasably lockably mounted in watertight sealed engagement within the doorway, and an open position wherein the door is clear of the aperture and substantially parallel to the sidewall (10*a*). A releasable latch (40, 48) and cooperating latch actuator (22) is provided for releasably latching engagement of the door in the watertight sealed engagement in the doorway and for releasing the door from such engagement upon actuation of the latch actuator (22) into a release position by a user in the enclosure. A latch release disabling means (52, 54, 56, 85, 60) is provided for disabling the latch actuator (22) when a fluid level in the enclosure is higher than a threshold level below a lowermost sill of the doorway.

17 Claims, 15 Drawing Sheets

U.S. PATENT DOCUMENTS

| | | | | |
|---|---|---|---|---|
| 3,423,769 | A | 1/1969 | Cowley | 4/556 |
| 3,863,275 | A | 2/1975 | Brendgord et al. | 4/556 |
| 3,864,762 | A | 2/1975 | Finch et al. | 4/555 |
| 3,885,349 | A * | 5/1975 | Owen | 49/220 |
| 4,099,272 | A | 7/1978 | Sowder | 4/555 |
| 4,399,569 | A | 8/1983 | Houle | 4/555 |
| 4,546,506 | A | 10/1985 | Houle et al. | 4/555 |
| 4,953,241 | A | 9/1990 | Williams | 4/556 |
| 5,056,169 | A | 10/1991 | Roguebrune | 4/556 |
| 5,184,358 | A | 2/1993 | Gruidel et al. | 4/555 |
| 5,701,614 | A | 12/1997 | Appleford et al. | 4/555 |
| 6,286,260 | B1 * | 9/2001 | Grabowski | 49/218 X |

FOREIGN PATENT DOCUMENTS

| | | |
|---|---|---|
| CA | 1177603 | 11/1984 |
| CA | 1264204 | 1/1990 |
| CA | 1267751 | 4/1990 |
| CA | 2022257 | 1/1992 |
| CA | 2195026 | 7/1998 |
| EP | 0 700 655 | 3/1996 |
| EP | 0 913 115 | 6/1999 |
| GB | 1 213 358 | 11/1970 |
| GB | 2 334 438 | 8/1999 |

* cited by examiner

Fig 18a
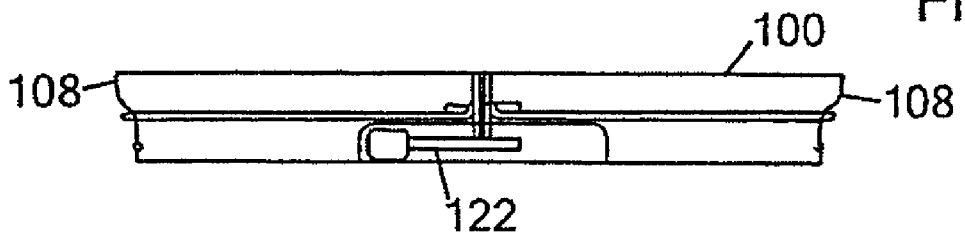
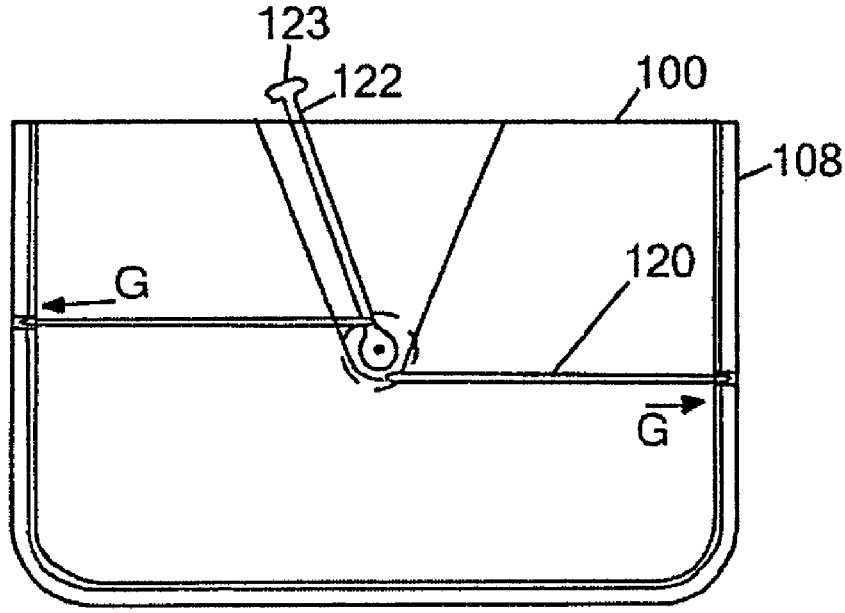
Fig 18b

BATHTUB HAVING SLIDING ACCESS DOOR FOR THE DISABLED AND ELDERLY

FIELD OF THE INVENTION

This invention relates to the field of bathtubs and in particular a bathtub having a door providing improved access for the disabled and elderly.

BACKGROUND OF THE INVENTION

It is well known that people with limited mobility such as disabled and elderly often require assistance to use a conventional bathtub in order to properly bathe because their limited mobility inhibits them from safely lowering themselves or lifting themselves out of a conventional bathtub.

To address such a need, applicant is aware of attempts in the prior art to provide bath enclosures with access doors. For example, applicant is aware of U.S. Pat. No. 3,423,769 which issued to Cowley for a Bath on Jan. 28, 1969, wherein Cowley discloses the use of a guillotine style door to provide access for infirm persons to a bathtub.

Applicant is also aware of United Kingdom Patent Specification Number 1,213,358 published Nov. 25, 1970 for The Improvements In Or Relating To Baths of Preston which discloses use of a sliding door to close an aperture in a bath, where the door slides horizontally on a guide upon the operation of a double-acting hydraulic cylinder and piston.

Applicant is also aware of European Patent Application Number 0 913 115 which was published May 6, 1999 for The Bath With A Side Access Opening Equipped With A Watertight Flap of Landi et al. which discloses a bath equipped with either a door hinged horizontally or vertically or a horizontally or vertically sliding door.

Applicant is further aware of United Kingdom Patent Application No. 2 334 438 published Aug. 25, 1999 for The Circular Sliding Door For A Bathtub of Nailer which discloses the use of a bathtub having a circular sliding door. The door slides sideways in both directions and moves forward and backward on rollers mounted to top and bottom of the door. The rollers run on runners which are fixed to panels above and below the rollers, the roller wheels interlocking with the runners. Hydraulic actuators hold the door when closed against a door seal.

SUMMARY OF THE INVENTION

In summary, the bathtub of the present invention includes a tub having an enclosure defined by at least one sidewall, where the sidewall has a doorway therein providing access from an external side of the sidewall, external to the enclosure, into the enclosure. At least one generally horizontal elongate guide, for example a vertically spaced apart pair of elongate guides are provided in the sidewall. A door is slidably mounted to the guide or guides on a plurality of pivotable linkage arms. The pivotable linkage arms are pivotally mounted to both the door and at least one of the guides, and is adapted for generally horizontal translation along the sidewall, in cooperation with the guide or guides, between a closed position wherein the door is releasably lockably mounted in watertight sealed engagement within the doorway, and an open position wherein the door is clear of the aperture and substantially parallel to the sidewall.

A releasable latch and a cooperating latch actuator is provided for releasable latching engagement of the door in the watertight sealed engagement in the doorway and for releasing the door from such engagement upon actuation of the latch actuator into a release position by a user in the enclosure. A latch release disabling means is provided for disabling the latch actuator when a fluid level in the enclosure is higher than a threshold level below a lowermost sill of the doorway.

In one embodiment not intended to be limiting, when the door is in the closed position, the pivotable linkage arms are generally parallel to the sidewall and, when the door is in the open position, the pivotable linkage arms are generally non-parallel, for example perpendicular to the sidewall. The pivotable linkage arms may include a pair of vertically spaced apart linkage arms, corresponding to the pair of elongate guides, mounted at a leading side edge of the door, where the leading side edge of the door corresponds to the side of the door closest to the guides when the door is in the closed position. The pivotable linkage arms may include a third linkage arm mounted to a trailing side edge of the door opposite the leading edge of the door.

The guides may be a pair of elongate parallel rails each having a slidable collar mounted thereon, in which case the pivotable linkage arms may be a pair of linkage arms each pivotally mounted to one of the slidable collars. The guides may include at least one channel in the sidewall, in which case a follower is provided for sliding along the channel mounted to a corresponding pivotable linkage arm.

In the open position, the door may be adjacent to either the external side of the sidewall or to an enclosure side of the sidewall opposite to the external side of the sidewall.

The latch may include at least one resiliently biased latch member, such as a bolt, which is resiliently urged into latched engagement with a latch member receiver so as to releasably engage the door with an edge of the doorway upon closing of the door into the closed position without actuation of the latch actuator by the user. In one embodiment the at least one resiliently biased latch member may include a conventional spring-loaded latch-bolt mounted in the door, in which case the latch member receiver is a bolt-receiving aperture in a striker plate in the edge of the doorway, the distal end of the latch-bolt having a wedge-shaped inclined surface so that as the protruding distal end of the latch-bolt strikes the striker plate, the bolt retracts into the door against the return biasing force of the spring. Once the bolt is aligned with the aperture in the striker plate, the spring shoots the end into the aperture.

The latch actuator may be a lever which at one end protrudes from the door for access by the user in the enclosure, and which at its opposite end is oscillatably mounted to the door. The lever is pivotally mounted to at least one latch drive arm mounted within the door and to the releasable latch for actuation of the latch into, and out of, the releasable latching engagement with the edge of the doorway. In one embodiment the releasable latch may be a plurality of latches mounted on opposite sides of the door. The at least one latch drive arm interconnects the plurality of latches with the lever for simultaneous actuation of the plurality of latches by oscillatable rotation of the lever relative to the door. The lever may protrude from an upper edge of the door and the plurality of latches may be mounted at four opposite corners of the door. The plurality of latches may be oriented so that actuation of the lever translates the latch members horizontally.

In one embodiment the latch release disabling means may be a float actuated linkage which includes a float mounted on a lever arm within a fluid reservoir. The float and the reservoir may be mounted in the sidewall. The reservoir is in fluid communication with tub enclosure so that a fluid level in the enclosure results in a corresponding fluid level in the reservoir. The lever arm cooperates with a drive linkage so that a fluid level in the reservoir above the threshold level actuates the drive linkage so as to cause a distal end of the drive linkage to interlock with a drive arm of the latch drive arm linkage in the door.

The lever may be generally vertical. The at least one latch drive arm may include a horizontal drive arm rotatably mounted to the lever between opposite ends of the horizontal drive arm, where the opposite ends of the horizontal drive arm actuate two oppositely disposed latches of the plurality of latches. A vertical drive arm may be provided in the door, linked at one end to the horizontal drive arm for vertical translation of the vertical drive arm simultaneously with horizontal translation of the horizontal drive arm, and linked at an opposite end to a third latch. In this embodiment the distal end of the drive linkage may engage the vertical drive arm to prevent the vertical translation of that drive arm upon the float reaching the threshold level.

BRIEF DESCRIPTION OF THE DRAWINGS

FIG. 6*a* is a sectional view, partially cut away, through a sidewall of the bathtub showing the mating of a pivot arm with a channel insert in the bathtub wall.

FIGS. 18*a* and 18*b* are, respectively, a partially cutaway plan view and a partially cut away front elevation view of the door of FIG. 12.

DETAILED DESCRIPTION OF PREFERRED EMBODIMENTS

This description is to be read in conjunction with the accompanying figures in which corresponding reference numbers in each view represent corresponding parts.

Figure 1:
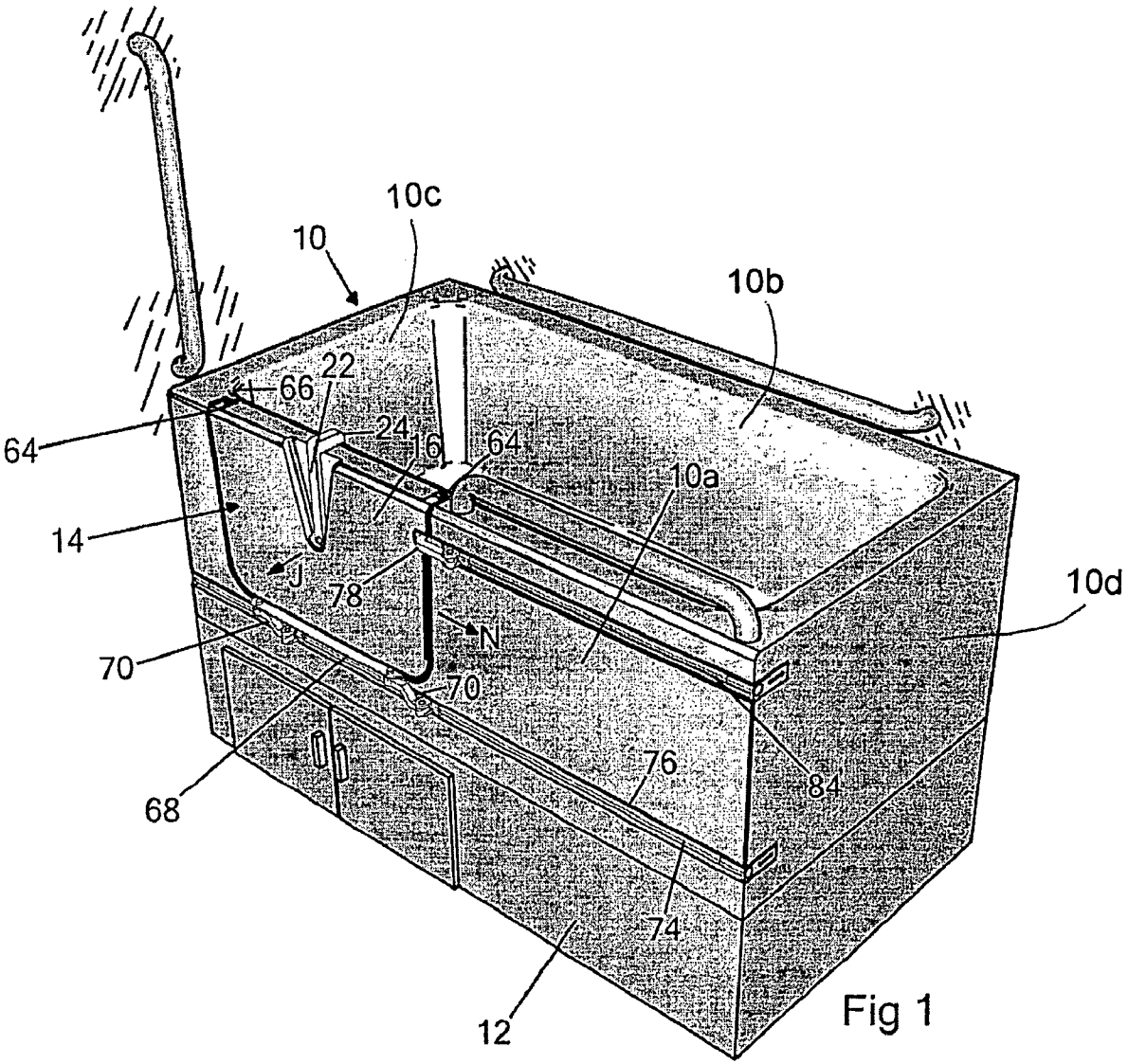
FIG. 1 is, in a front, right side perspective view, a bathtub incorporating the access door of the present invention.

As seen in FIG. 1, bathtub 10 is elevated, mounted on a frame or pedestal 12 so that a door 14 mounted to one side wall 10*a* of the bathtub is elevated. Sidewall 10*a* and the opposite sidewall 10*b*, and the end walls 10*c* and 10*d* define a bathtub enclosure. Bathtub 10 may be elevated so that the side door opening or doorway occupied by door 14 when in its closed position is level with a typical chair seat elevation. For example, the floor of bathtub 10 may be elevated to correspond to a typical wheelchair height of 17.5 inches, although this is not intended to be limiting. Pedestal 12 may be used for storage and provides for ease of access for maintenance, etc. The bathtub and pedestal may be sized to replace an existing conventional bathtub.

As better seen in FIGS. 2–5, wherein the cover 16 of door 14 is either removed or shown in dotted outline, the cover 16 encloses a lock actuating mechanism 20. In particular, lock actuating mechanism 20 includes an operating lever 22 protruding upwardly from the door and having a handle 24 cantilevered towards the bathtub enclosure at an upper end of the lever. Lever 22 is oscillatably pivotally mounted, for example by means of shaft 26, to mounting or backing plate 28 rigidly mounted to an interior surface of door cover 16.

Crank arm 30 is also mounted on shaft 26 and may be rigidly mounted to lever 22, for example by means of collar 32, so that rotation of lever 22 in direction A about shaft 26 simultaneously correspondingly rotates crank arm 30 to thereby translate cross arm 34 in direction B. Cross arm 34 acts as a latch drive arm, in this embodiment driving bell crank members 36, whereby rotation of lever 22 about shaft 26 unlatches four spring-loaded door latches. In particular, translation of cross arm 34 in direction B rotates upper bell crank members 36 about axes of rotation C to thereby actuate, that is, retract upper spring-loaded door latch bolts or members 38 into conventional door latch mechanisms 40. Such rotation of upper bell crank members 36 simultaneously drives a pair of corresponding connecting rods 42 in direction D so as to simultaneously rotate lower bell crank members 44 about axes of rotation E. Thus, rods 42 also act as latch drive arms, rotating lower bell crank members 44 to thereby retracts lower spring-loaded door latch bolts or members 46 into door latch mechanisms 48. Door latch mechanisms 40 and 48 and their respective latch members 38 and 46 form releasable latches, and are actuated by a latch actuator, in this case lever 22, arms 30, 34, rods 42, and bell cranks 36, 44.

Figure 4:
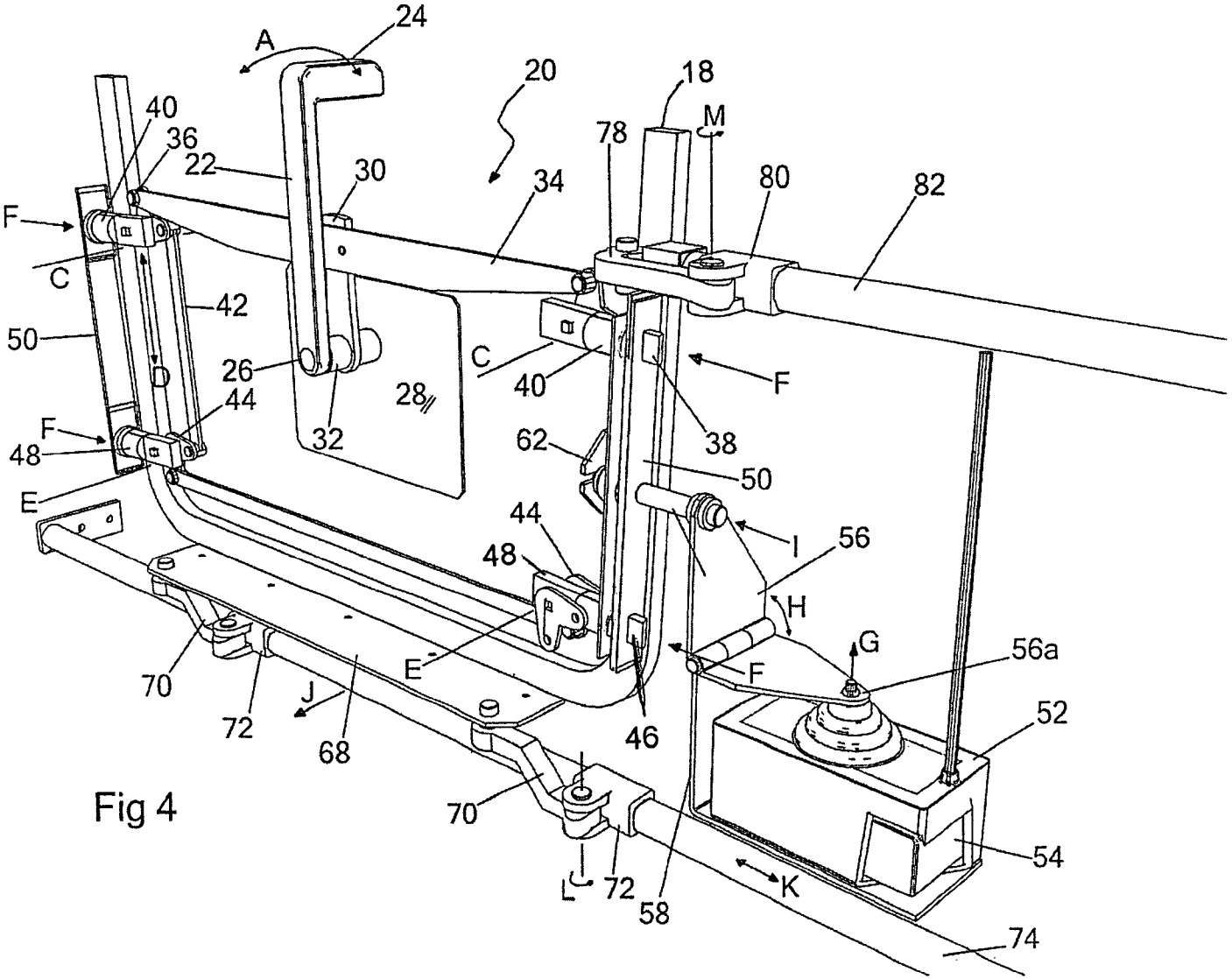
FIG. 4 is, in enlarged and partially cut away view, the access door and locking mechanism of FIG. 2.

Door latch members 38 and 46 are thus simultaneously retracted by operation of lever 22 so as to retract the door latch members inwardly of the door in direction F as seen in FIG. 4 thereby retracting the door latch members from engagement in correspondingly sized apertures in a latch member receiver such as plates 50 mounted to the opposed facing surfaces of the door opening in bathtub sidewall 10*a*. The spring-loaded door latch members automatically engage or re-engage the apertures in plates 50 under the resilient return-biased urging of their spring mechanisms so as to lock door 16 in watertight sealed engagement within the door opening of sidewall 10*a*.

Figure 2:
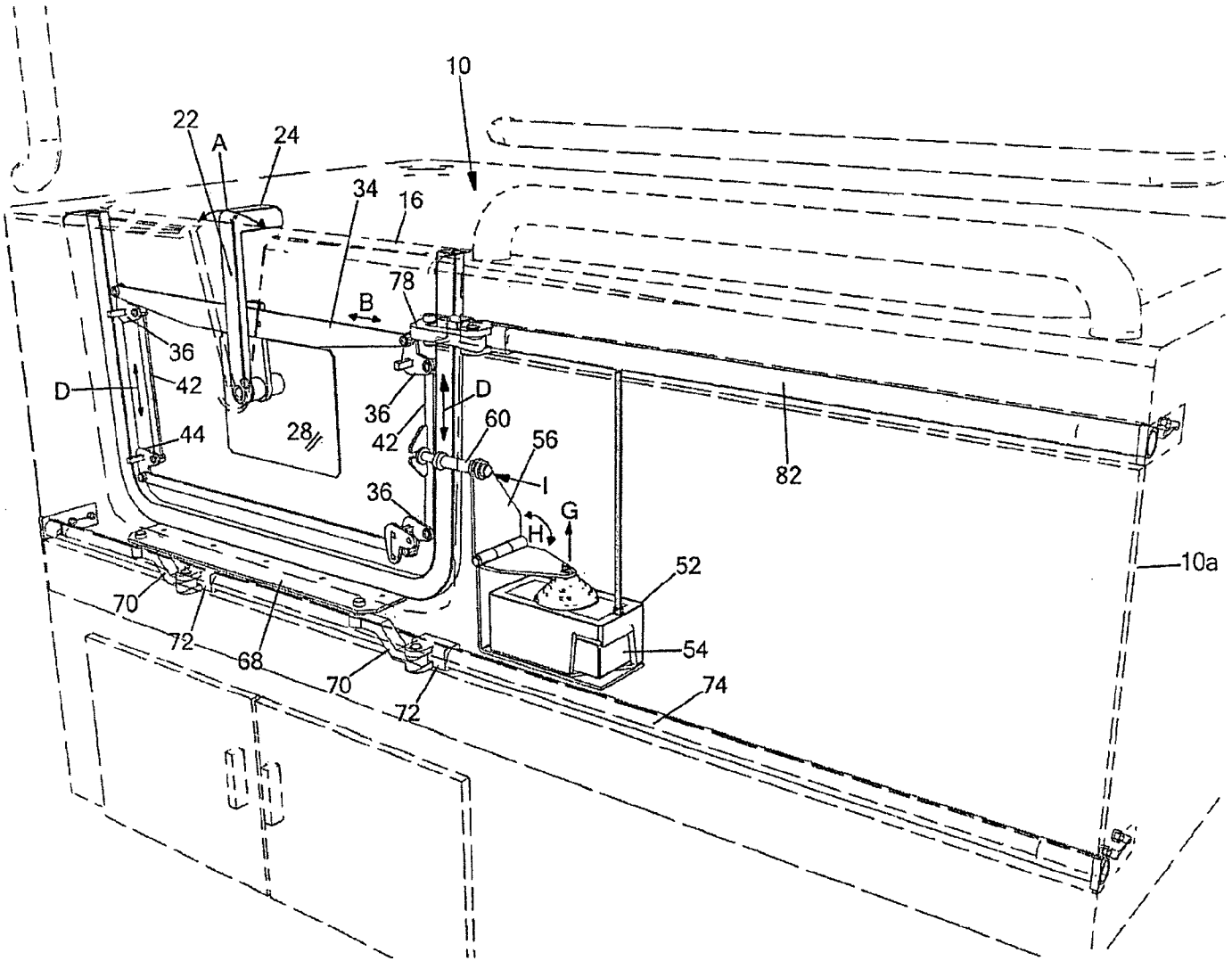
FIG. 2 is the view of FIG. 1 with the access door cover shown in dotted outline and the bathtub shown in dotted outline.
Figure 3:
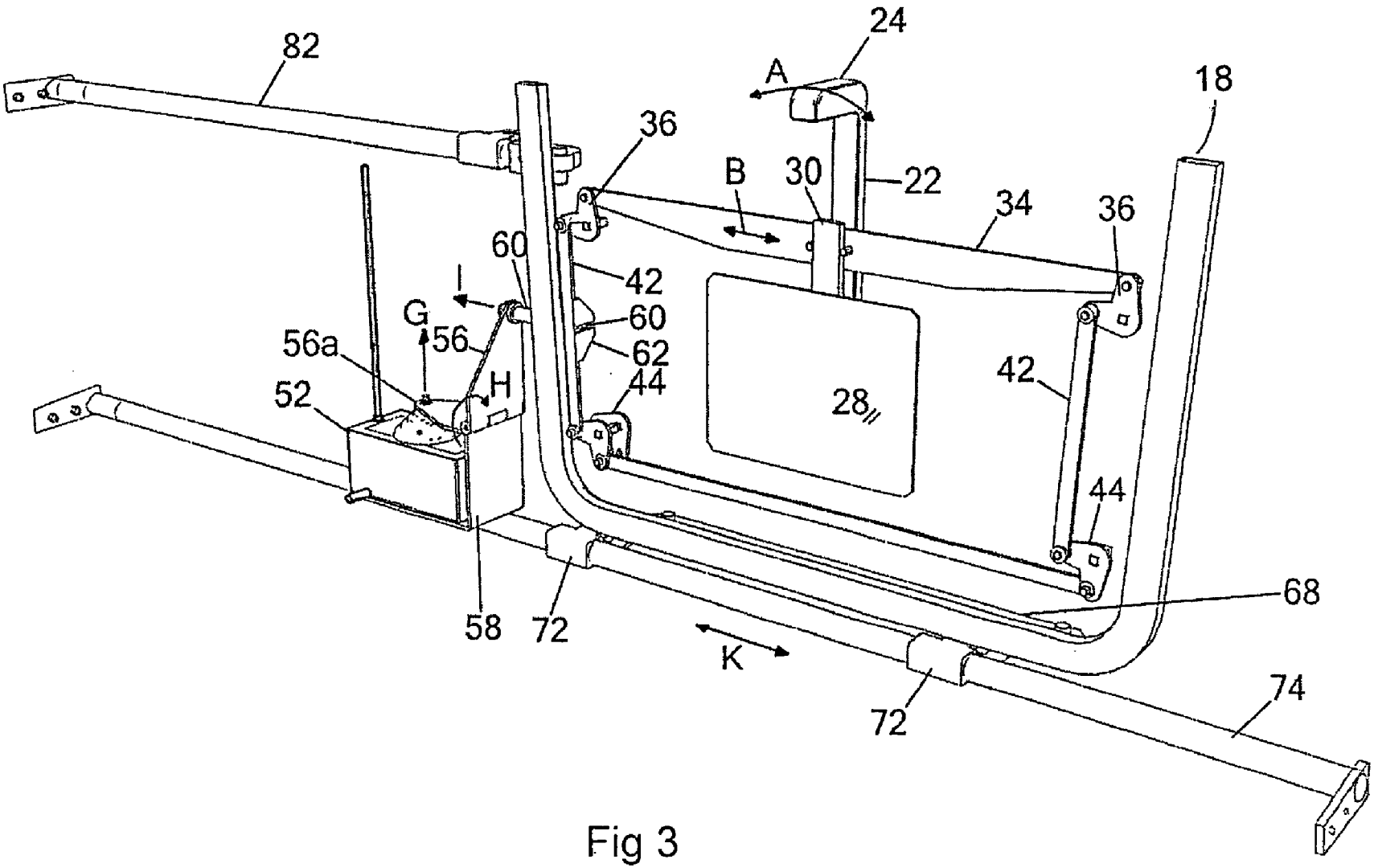
FIG. 3 is, in enlarged rear, left side perspective view, the access door of FIG. 2.
Figure 5:
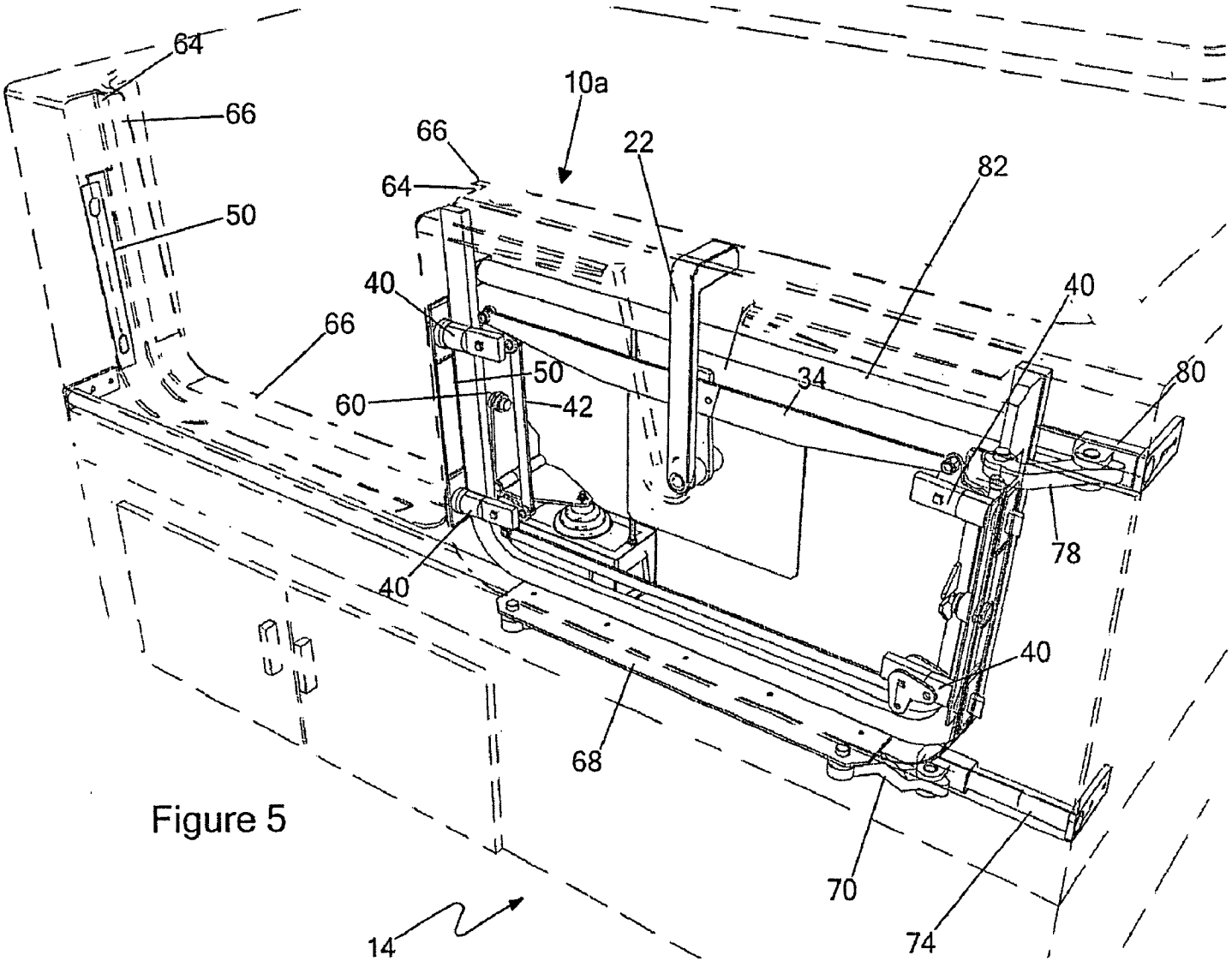
FIG. 5 is the door of FIG. 4 in the open position.

What follows is a description of one embodiment of a release disabling means for disabling the latch actuator. A water reservoir 52 is mounted within sidewall 10*a*. Reservoir 52 is in fluid communication with the inside of bathtub 10 that as bathtub 10 is filled with water, so too water fills reservoir 52 to a corresponding level until reservoir 52 is full. In FIGS. 2, 4, and 5, reservoir 52 is shown partially cut away so that internal float 54 may be seen. As the water lever rises within reservoir 52 corresponding to the level of water with bathtub 10, float 54 rises with the water level in the reservoir so as to drive upwardly in direction G end 56*a* of a float actuated linkage such as bell crank 56. Bell crank 56 is rotatably mounted to a supporting member 58 for pivoting rotation in direction H so that actuation of end 56*a* in direction G by the urging of a rising float 54 in reservoir 52 rotates the bell crank. Rotation of the bell crank drives a pin 60 in direction I through a corresponding aperture in plate 50 and into mating engagement with an apertured or channelled plate 62 rigidly mounted to one of the connecting rods 42. With pin 60 so mated the reverse actuation of lock actuating mechanism 20 is prevented. Thus, when water is in the bathtub, the mating of pin 60 in plate 62 prevents the unlocking of door 14 which might otherwise be inadvertently unlocked by a user operating lever 22 resulting in flooding of the bathroom.

When water is not present in bathtub 10, so that the lowering of float 54 in reservoir 52 has resulted in the retraction of pin 60 from locking engagement within plate 62, a user may then grasp handle 24 and operate lever 22 so as to retract latch members 38 and 46 from their locking engagement in plates 50. This then unlocks door 14 from its locked engagement within the door opening of sidewall 10*a* allowing the door to be opened.

Door 14 is opened once the door latches are released by a user pushing the door outwardly of the bathtub from the door's co-planar relation with sidewall 10*a*. A user pushing door 14 outwardly in direction J as seen in FIG. 1 unseats the door from the door's watertight seals 64 mounted circumferentially around the inner surface of the door opening circumferential lip 66.

Such outward translation of door 14 in direction J also correspondingly outwardly translates door supporting plate 68. Plate 68 supports door 14. A pair of pivot arms 70 are pivotally mounted at first ends of the pivot arms to door supporting plate 68 and at opposite second ends of the pivot arms to sliding sleeves or collars 72. Sliding collars 72 are free to slide in direction K along a linear rail or rod 74 which serves as an elongate guide mounted recessed into channel 76 in sidewall 10*a*. Similarly, pivot arm 78 is pivotally mounted at its first end to frame 18, or otherwise to door 14, and at its opposite second end to sleeve or collar slide 80. Collar slide 80 is slidably mounted on a rail or rod 82. Rod 82 is an elongate guide mounted parallel to, and vertically spaced from, rod 74 within channel 84 of sidewalls 10*a*. Thus, translation of door 14 in direction J upon opening of the door rotates lower pivot arms 70 in direction L and upper pivot arm 78 in direction M from their closed position generally parallel to sidewall 10*a* thereby swinging door 14 outwardly of rods 74 and 82 while maintaining door 14 parallel to the plane containing rods 74 and 82. Once door 14 is swung clear of the door opening in sidewall 10*a*, the door may be translated by sliding the door in direction N as seen in FIG. 1 along the length of rods 74 and 82 to thereby completely open the door opening as seen in FIG. 5 for access by a user.

Door 14 is closed and locked by reversing the opening procedure, with the exception that lever 22 does not have to be operated to re-latch the door latching members in the apertures in plates 50, as the spring-loading of the members automatically seats the members in the apertures.

Figures 6, 6B:
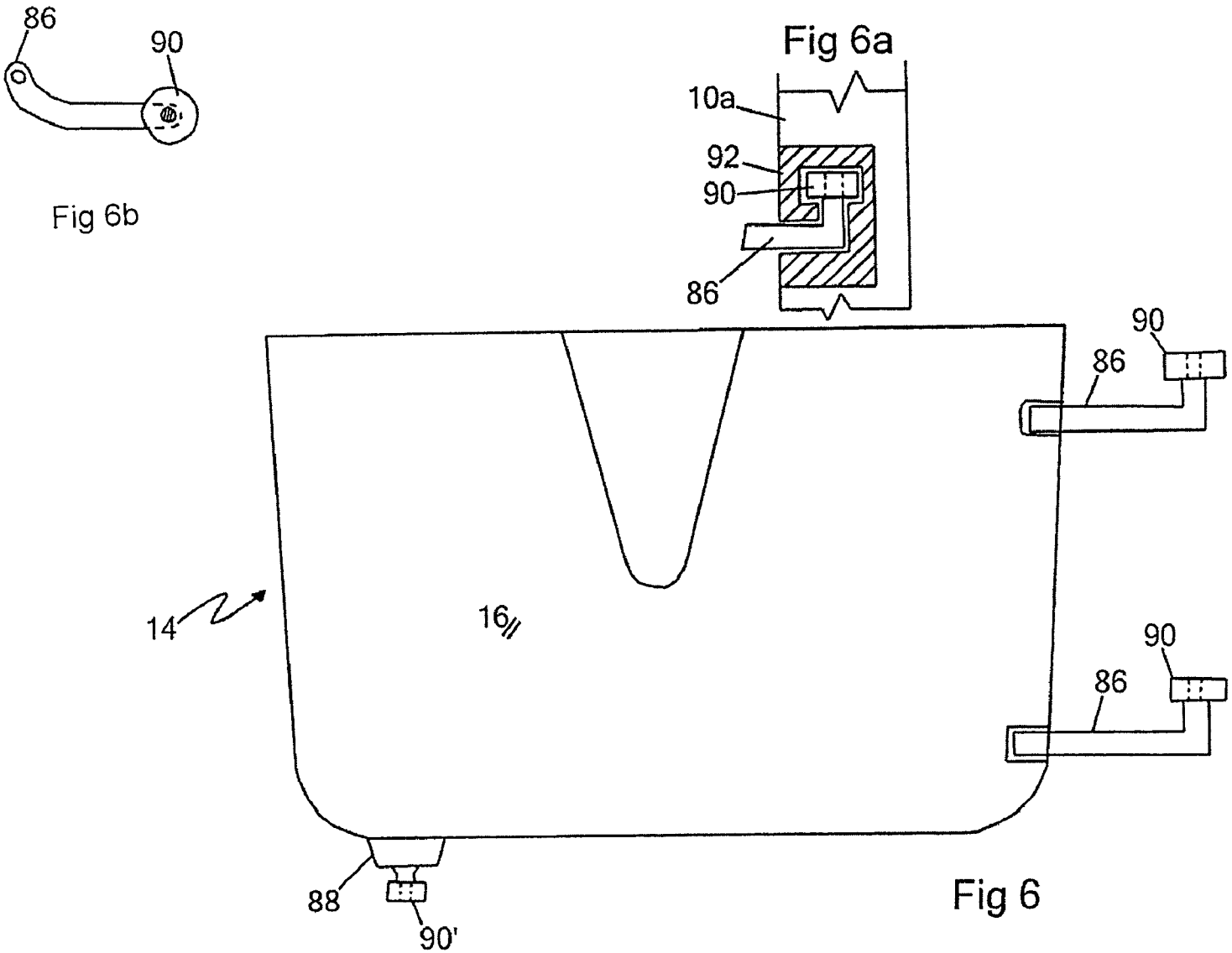
FIG. 6 is, in front elevation view, an alternative embodiment of the access door of the present invention.
FIG. 6*b* is, in plan view, one of the pivot arms and roller wheels of FIG. 6.
Figure 7:
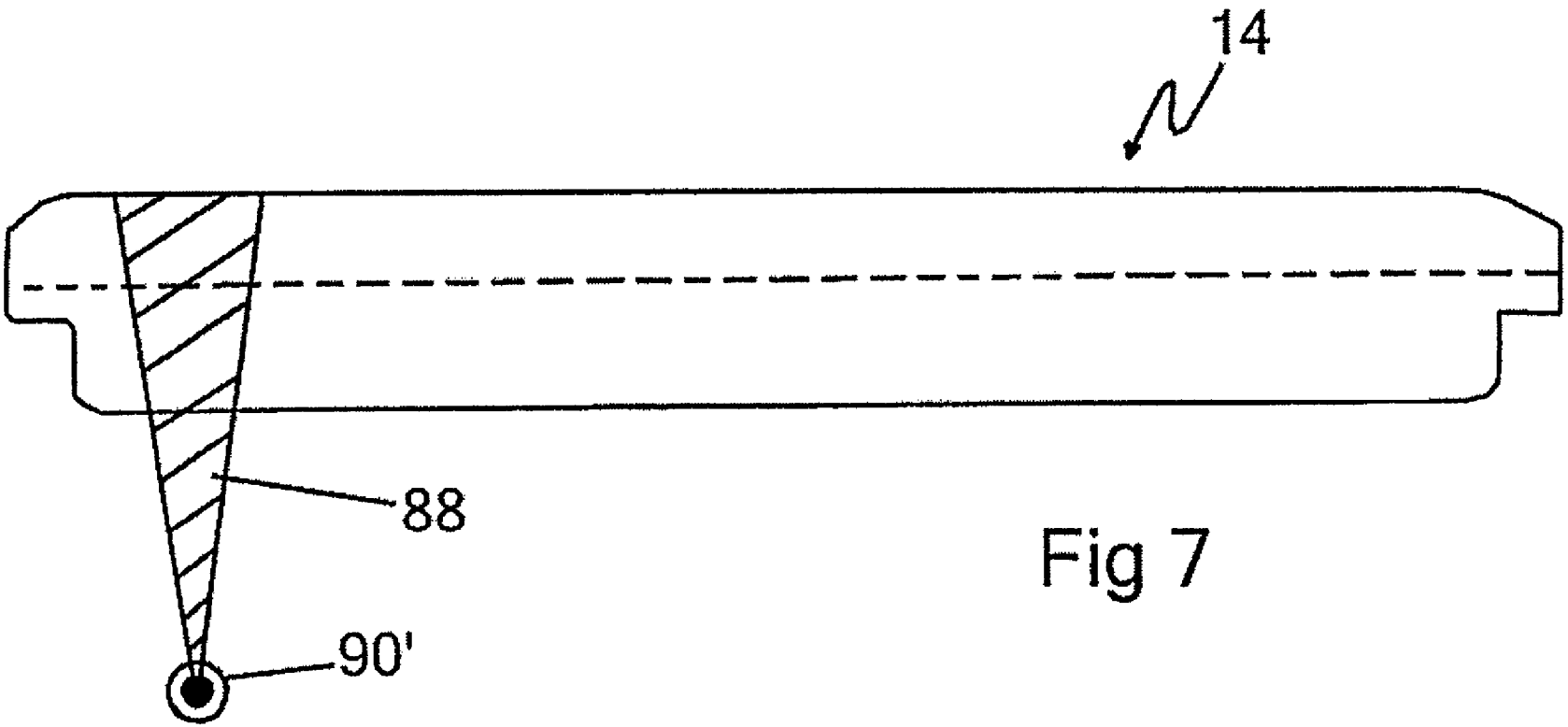
FIG. 7 is, in bottom view, the door and door guide of FIG. 6.
Figure 8:
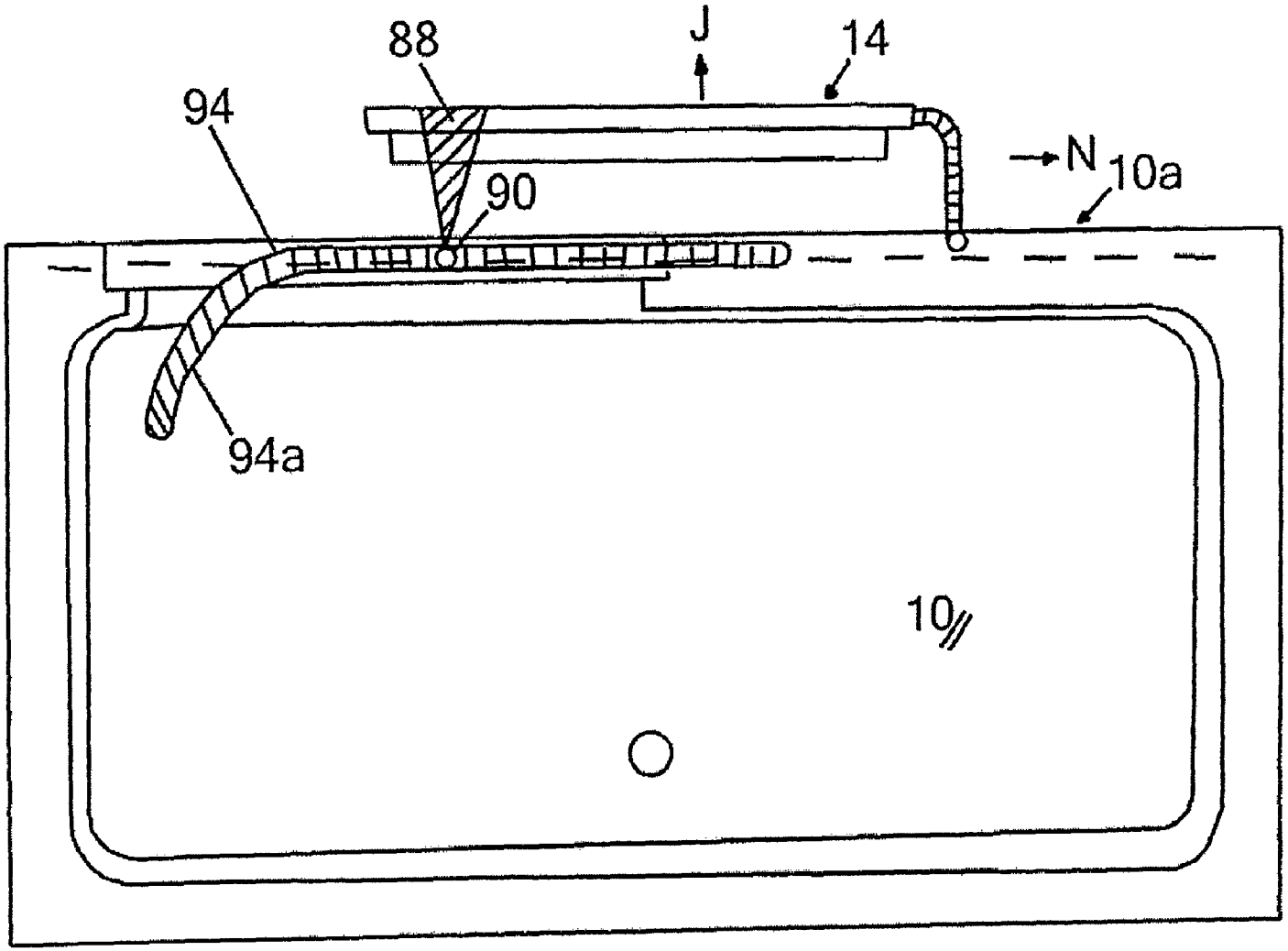
FIG. 8 is, in partially cut away bottom view, the access door of FIG. 6 mounted to a door guide channel formed below the bathtub.

In an alternative embodiment such as seen in FIGS. 6–8, door 14 is mounted on a pair of parallel vertically spaced apart pivot arms 86 at a first end of the door, and on a door guide 88 mounted towards the opposite second end of the door so as to depend downwardly from door 14. In this embodiment, channels 76 and 84 in sidewall 10*a* are shaped to receive therein, along the length of the channels, the distal ends of pivot arms 86 and their corresponding rotatably mounted roller wheels 90. As better seen in FIG. 6*a*, the channels may be formed by the use of channel inserts 92 mounted into sidewall 10*a*. Pivot arms 86 are pivotally mounted to door 14 so that, once locking mechanism 20 is disengaged, as before, door 14 may be translated outwardly of the tub in direction J so as to clear the first end of the door from the door opening in sidewall 10*a* so as to allow translation of the door along the channels in direction N.

As seen in FIG. 7, door guide 88 extends rigidly cantilevered outwardly from the bottom of door 14. Similar to pivot arms 86, it too has a roller wheel 90' rotatably mounted at its distal end. As seen in FIG. 8, roller wheel 90' mates in door guide track or channel 94 formed in a support (not shown) mounted below the lower surface of bathtub 10. Channel 94 has an arcuate or curved end 94*a* at an end of channel 94 opposite to channels 76 and 84. Thus as door 14 is being closed by being translated in a direction opposite to direction N, roller wheel 90' on door guide 88 follows the curved end 94*a* of channel 94 to draw door 14 into the door opening in sidewall 10*a* in a direction opposite to direction J. The pivoting of pivot arms 86 relative to channels 76 and 84 and relative to door 14 allow the door to be drawn into the door opening in sidewall 10*a* by the operation of roller wheels 90' following curved end 94*a* of channel 94. Roller wheel 90' reaching the end, or near to the end of curved end 94*a* of channel 94 coincides with door 14 seating into the door opening of sidewall 10*a* so that locking mechanism 20 may be actuated to lock the door in its closed position.

Figure 9:
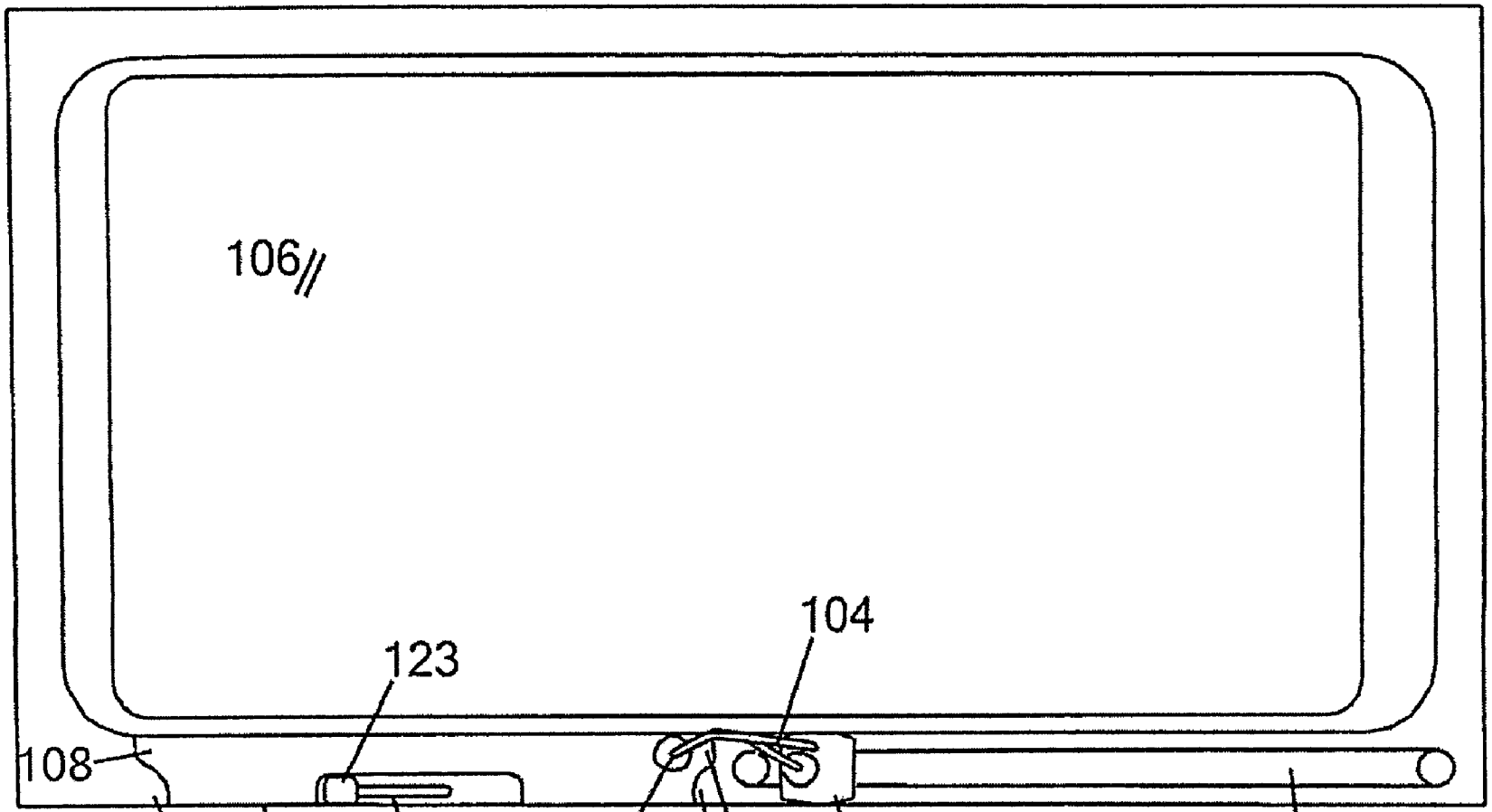
FIG. 9 is, in plan view, a third embodiment of the bathtub of the present invention having a sliding access door, showing the door closed.
Figure 10:
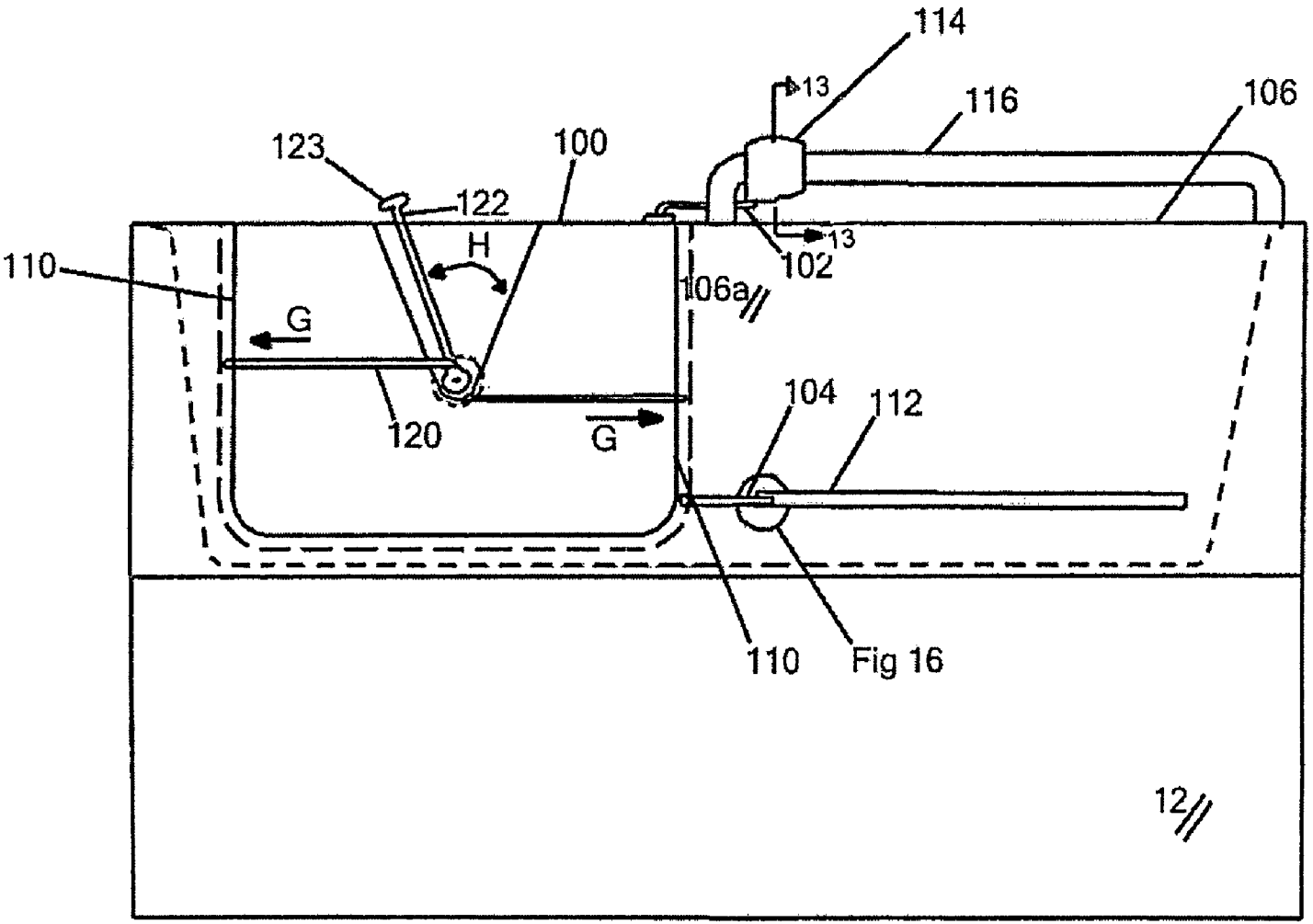
FIG. 10 is, in side elevation view, the bathtub and sliding access door of FIG. 9.
Figure 11:
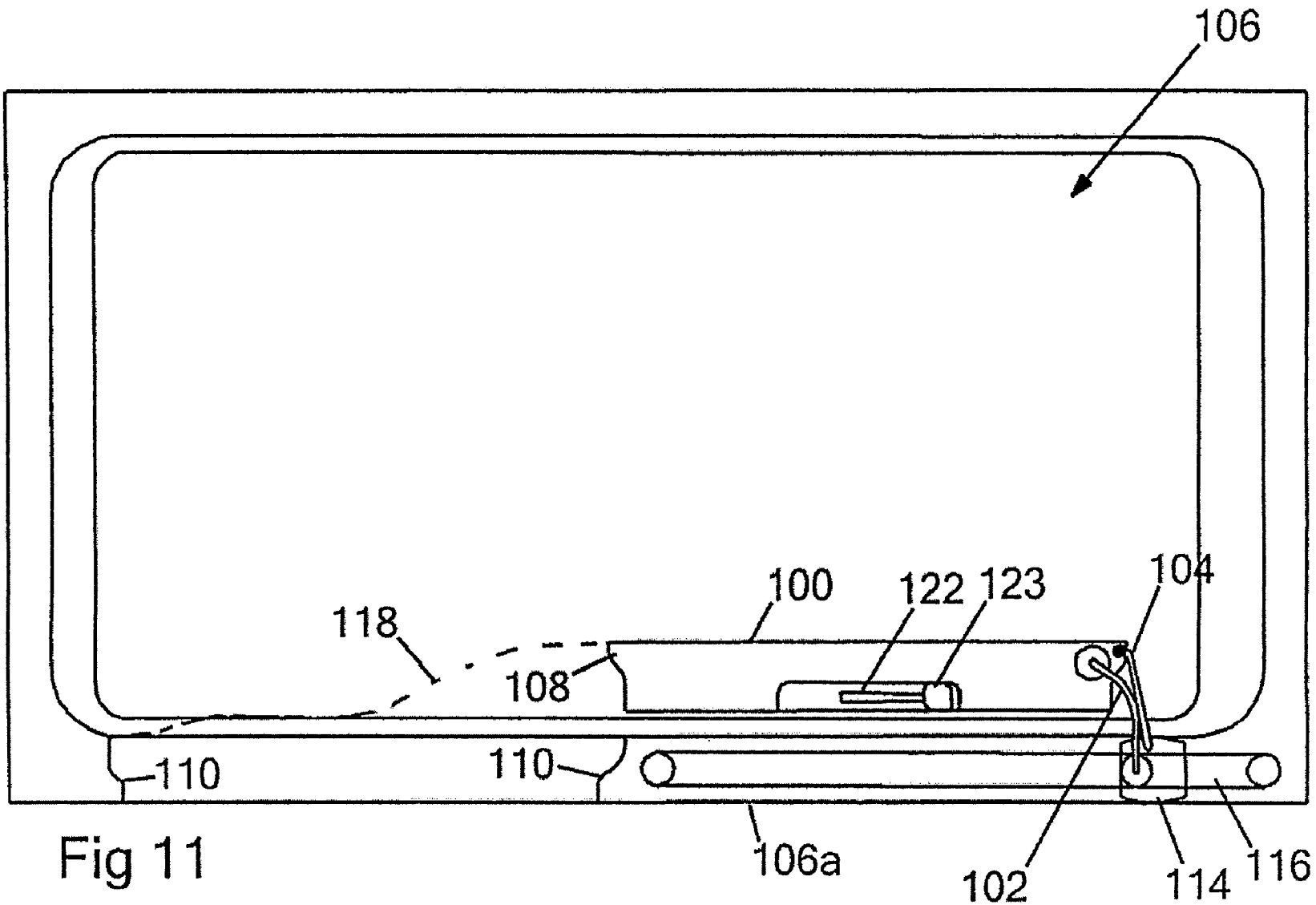
FIG. 11 is, in plan view, the bathtub and sliding access door of FIG. 9 showing the door in its opened position.
Figure 12:
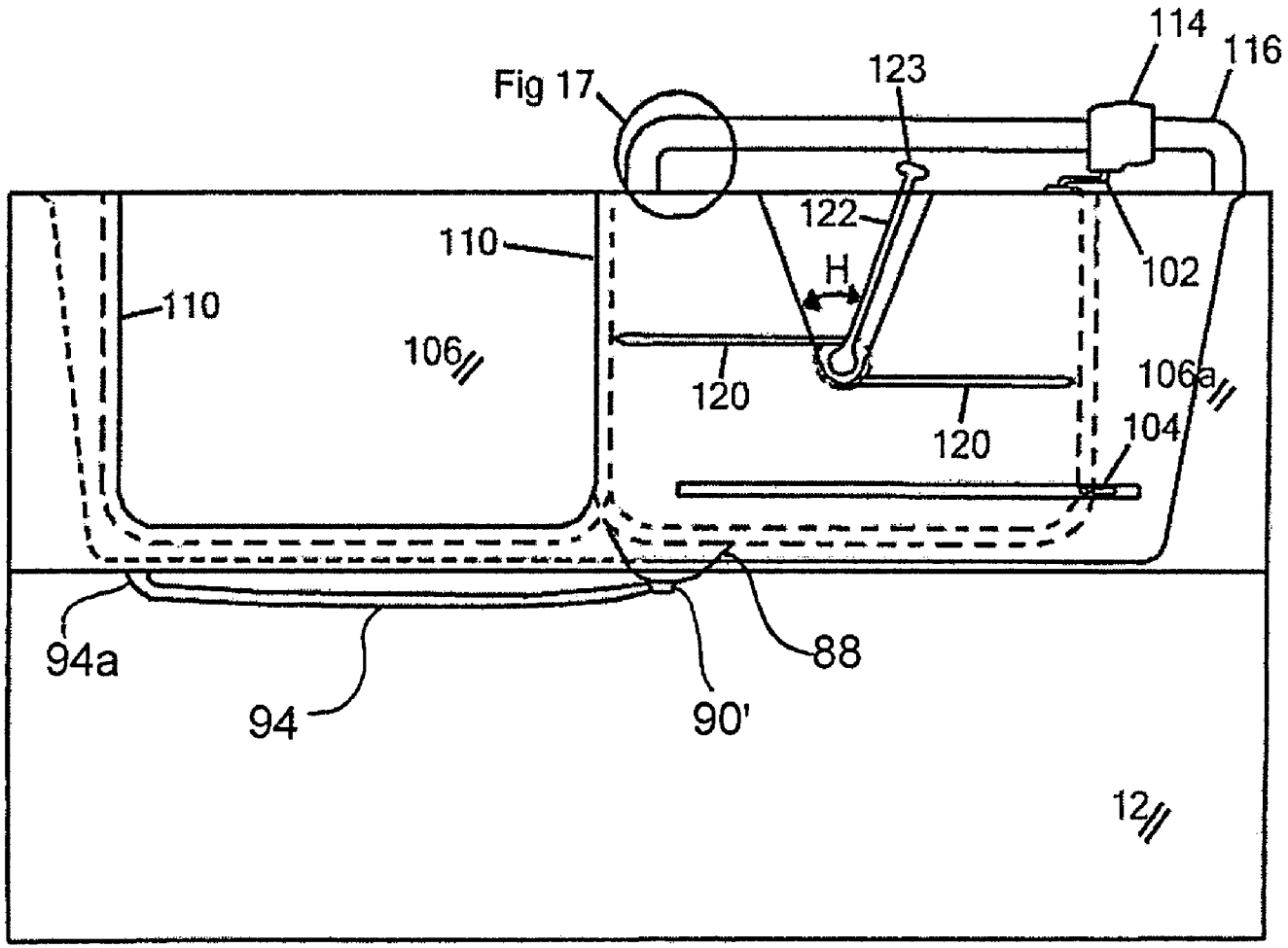
FIG. 12 is, in side elevation view, the bathtub and sliding access door of FIG. 11.

In a third embodiment of the present invention, as seen in FIGS. 9 and 10 which show a bathtub with door 100 closed, and as seen in FIGS. 11 and 12 which show the bathtub with door 100 in the open position, the door may pivot on upper and lower door pivot arms 102 and 104 respectively. Door 100 opens to the inside, that is, into the enclosure of bathtub 106 so as to slidably translate between the closed position of FIGS. 9 and 10 wherein the outwardly flared circumferential lip 108 of door 100 seats against door opening perimeter lip 110 so as to make a watertight seal, and the open position of FIGS. 11 and 12 wherein door 100 has been slid into the interior of bathtub 106 into a position parallel with side wall 106*a*.

Figure 13A:
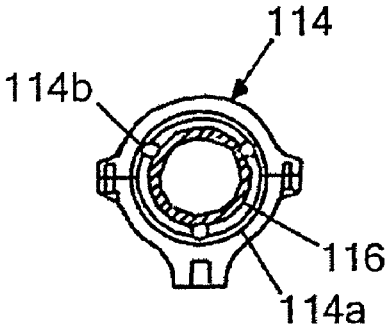
FIGS. 13*a* and 13*b* are, respectively in sectional view along line 13—13 and side elevation view, the sliding door guide of the access door of FIG. 10.
Figure 13B:
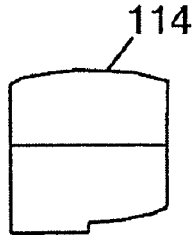
Figure 14A:
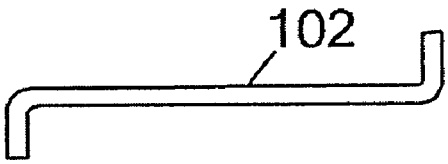
FIGS. 14*a* and 14*b* are, respectively in side elevation view and plan view, the upper door pivot arm of the sliding access door of FIG. 9.
Figure 15A:
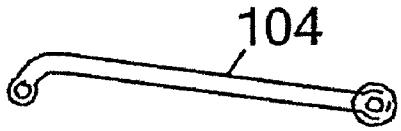
FIGS. 15*a* and 15*b* are, respectively in plan view and side elevation view, the lower door pivot arms of the access door of FIG. 9.
Figure 14B:
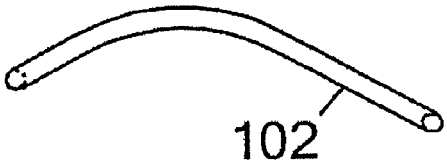
Figure 15B:
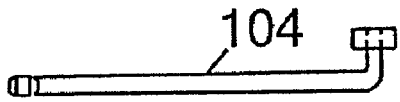
Figure 16:
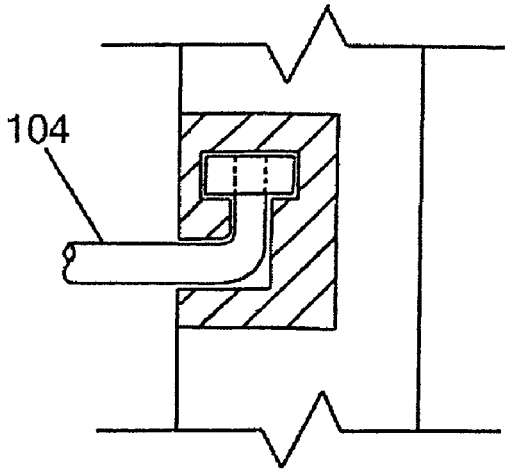
FIG. 16 is an enlarged partially sectioned view of the roller mounting of the end of the lower door pivot arm within the channel insert within the tub side wall of FIG. 10.
Figure 17A:
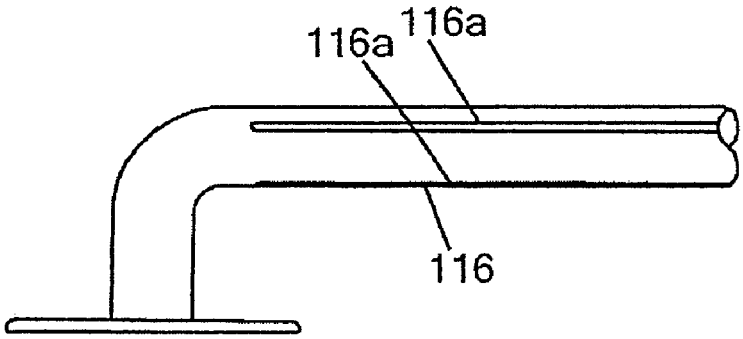
FIGS. 17*a* and 17*b* are, in enlarged partially cut away view and in section view respectively, the hand rail of FIG. 12.
Figure 17B:
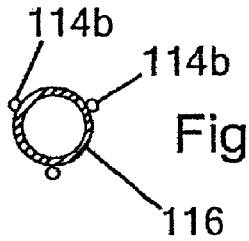

As may be seen in FIG. 10 by the partial cutting away of side wall 106*a*, one end of lower door pivot arm 104 is rotatably mounted to a first end of door 100, and the other end of the lower door pivot arm is slidably mounted within a stainless steel channel 112 mounted into the inner wall of side wall 106*a*. Upper door pivot arm 102, better seen in FIGS. 14*a* and 14*b*, is mounted generally parallel to lower door pivot arm 104 better seen in FIGS. 15*a* and 15*b*. One end of the upper door pivot arm 102 is rotatably mounted to the first end of door 100, and the opposite end of upper door pivot arm 102 rotatably mounted to a sliding collar such as sliding door guide 114 better seen in FIGS. 13*a* and 13*b*. Guide 114 is slidably mounted onto hand rail 116 better seen in FIGS. 17*a* and 17*b*. Hand rail 116 is rigidly mounted to the upper edge of side wall 106*a*. A low friction line 114*a* of UHMW plastic and the use of stainless steel or UHMW plastic rollers 114*b* facilitates ease of sliding, rollers 114*b* constrained in grooved profiles 116*a* on rail 116. Thus, as door 100 slidably translates between its open and closed positions, the door is free to travel horizontally along an arcuate trajectory such as arcuate trajectory 118 as seen in FIG. 11 by the pivoting action of the door pivot arms which support the door in relation to the side wall of the tub.

As also seen in FIGS. 18*a* and 18*b*, when in its closed position, door 100 may be releasably locked or latched into place by the operation of latch pins 120 translating horizontally outwardly in directions G so as to journal the distal ends of the latch pins in correspondingly sized holes in the opposed facing sides of lip 110 seen in FIGS. 9–12. Latch pins 120 are translated outwardly in directions G and are retracted in opposite directions by the rotation of lever 122 in direction H. Lever 122 has a handle, grip or knob 123 at its free end. With door 100 seated against lip 110, lever 122 may be rotated in direction H so as to lock door 100 within the side wall of the tub by the actuation of latch pins 120 in directions G. By operation of lever 122 in a reversed direction, the ends of latch pins 120 may be retracted, freeing door 100 for opening. In a further alternative embodiment, door 100, with its corresponding pivot arms, sliding door guide, and latch pin arrangement, could be made to slide to the outside of side wall 106*a*.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A bathtub for the disabled or elderly comprising:

a tub having an enclosure defined by at least one sidewall, said sidewall having a doorway therein providing access from an external side of said sidewall, external to said enclosure, into said enclosure, a generally horizontal vertically spaced apart pair of elongate guides in said sidewall, a door slidably mounted to said guides on a plurality of pivotable linkage arms pivotally mounted to both said door and at least one of said guides for generally horizontal translation along said sidewall between a closed position wherein said door is releasably lockably mounted in watertight sealed engagement within said doorway, and an open position clear of said aperture and substantially parallel to said sidewall, a releasable latch and cooperating latch actuator for releasable latching engagement of said door in said watertight sealed engagement in said doorway and for releasing said door from such engagement upon actuation of said latch actuator into a release position by a user in said enclosure, wherein, when said door is in said closed position, said plurality of pivotable linkage arms are generally parallel to said sidewall and, when said door is in said open position, said plurality of pivotable linkage arms are generally non-parallel to said sidewall.

2. The bathtub of claim 1 further comprising a latch release disabling means for disabling said latch actuator when a fluid level in said enclosure is higher than a threshold level below a lowermost sill of said doorway.

3. The bathtub of claim 1 wherein when said plurality of pivotable linkage arms are generally non-parallel to said sidewall, said plurality of pivotable linkage arms are generally perpendicular to said sidewall.

4. The bathtub of claim 1 wherein said plurality of pivotable linkage arms includes a pair of vertically spaced apart linkage arms, corresponding to said pair of elongate guides, mounted at a leading side edge of said door, wherein said leading side edge corresponds to the side of said door closest to said guides when said door is in said closed position.

5. The bathtub of claim 4 wherein said plurality of pivotable linkage arms includes a third linkage arm mounted to a trailing side edge of said door opposite said leading edge.

6. The bathtub of claim 4 wherein said guides are a pair of elongate parallel rails each having a slidable collar mounted thereon, and said plurality of pivotable linkage arms is a pair of linkage arms each pivotally mounted to one of said slidable collars.

7. The bathtub of claim 1 wherein said guides include at least one channel in said sidewall, and wherein a follower for sliding along said channel is mounted to a corresponding one of said plurality of pivotable linkage arms.

8. The bathtub of claim 1 wherein, in said open position, said door is adjacent said external side of said sidewall.

9. The bathtub of claim 1 wherein in said open position, said door is adjacent an enclosure side of said sidewall opposite said external side of said sidewall.

10. The bathtub of claim 1 wherein said latch actuator is a lever which at one end protrudes from said door for access by the user in said enclosure, and which at its opposite end is oscillatably mounted to said door, wherein said lever is pivotally mounted to at least one latch drive arm mounted within said door and to said releasable latch for actuation of said latch into, and out of, said releasable latching engagement, and wherein said releasable latch is a plurality of latches mounted on opposite sides of said door and wherein said at least one latch drive arm interconnects said plurality of latches with said lever for simultaneous actuation of said plurality of latches by rotation of said lever relative to said door.

11. The bathtub of claim 10 wherein said lever protrudes from an upper edge of said door and wherein said plurality of latches are mounted at four opposite corners of said door.

12. The bathtub of claim 11 wherein said plurality of latches are oriented so that actuation of said lever translates said latch members of said plurality of latches horizontally.

13. The bathtub of claim 12 wherein said latch release disabling means is a float actuated linkage including a float mounted on a lever arm within a fluid reservoir, wherein said reservoir is in fluid communication with enclosure so that a fluid level in said enclosure results in a corresponding fluid level in said reservoir, said lever arm cooperating with a drive linkage so that a fluid level in said reservoir above said threshold level actuates said drive linkage so as to cause a distal end of said drive linkage to interlock with a drive arm of said at least one latch drive arm.

14. The bathtub of claim 13 wherein said lever is generally vertical and wherein said at least one latch drive arm includes a horizontal drive arm rotatably mounted to said lever between opposite ends of said horizontal drive arm, said opposite ends of said horizontal drive arm actuating two oppositely disposed latches of said plurality of latches.

15. The bathtub of claim 14 wherein a vertical drive arm in said door is linked at one end to said horizontal drive arm for vertical translation of said vertical drive arm simultaneously with horizontal translation of said horizontal drive arm, and linked at an opposite end to a third latch of said plurality of latches.

16. The bathtub of claim 15 wherein said distal end of said drive linkage engages said vertical drive arm to prevent said vertical translation upon said float reaching said threshold level.

17. The bathtub of claim 16 wherein said float and said reservoir are mounted in said sidewall.

* * * * *